United States Patent [19]

Cato

[11] 4,069,535

[45] Jan. 24, 1978

[54] PIPELINE PIG

[76] Inventor: Bennie D. Cato, 328 Bedford Road, Apt. 116, Bedford, Tex. 76021

[21] Appl. No.: 365,156

[22] Filed: May 30, 1973

[51] Int. Cl.[2] ..... B08B 9/04

[52] U.S. Cl. ..... 15/104.06 R; 166/153

[58] Field of Search ..... 15/104.06 R, 104.06 A; 166/153–156; 137/268

[56] References Cited

U.S. PATENT DOCUMENTS

| | | | |
|---|---|---|---|
| 1,756,378 | 4/1930 | Oberhuber | 15/104.06 R |
| 1,855,646 | 4/1932 | Oberhuber | 15/104.06 R |
| 2,156,260 | 5/1939 | Crothers | 15/104.06 R UX |
| 2,763,017 | 9/1956 | Redin | 15/104.06 R |
| 3,056,156 | 10/1962 | Immel | 15/104.06 R |
| 3,102,595 | 9/1963 | Fisher, Jr. et al. | 166/156 |

*Primary Examiner*—Edward L. Roberts

*Attorney, Agent, or Firm*—Wofford, Felsman, Fails & Zobal

[57] ABSTRACT

The specification discloses a pipeline pig comprising an elongated cylindrical member having a front end and a rear end; a plurality of spaced annular flexible rings circumscribing the member and extending radially outward from the member for contacting the inside wall of the pipeline; and an elongated central aperture extending from the rear end of the member to a point beyond its midpoint and near the front end thereof for receiving fluid pressure to facilitate movement of the pig through a pipeline.

9 Claims, 7 Drawing Figures

PIPELINE PIG

BACKGROUND OF THE INVENTION

This invention relates to a pipeline pig to be propelled through a pipeline by fluid pressure and which is trouble free but yet provides an effective seal between the pig and the inside wall of the pipeline.

Heretofore, the oil industry has employed pipeline pigs in pipelines for the purposes of cleaning, de-watering, batching, etc., however, problems have existed with the known pigs in that in many instances they become stuck in the pipeline or do not provide an effective seal between the pig and the pipeline. These problems occur in the pipeline at tight spots, sharp turns, or in a pipeline formed by pipe sections having different diameters. If the pig becomes stuck in the pipeline, costly operations are necessary to locate the pig and to remove the pig from the pipeline.

SUMMARY OF THE INVENTION

It is an object of the present invention to provide a pipeline pig which avoids the above problems and which is constructed to allow the fluid in the pipeline to pull the pig through a pipeline and yet which maintains a seal between the pig and the inside surface of the pipeline.

The pipeline pig comprises an elongated flexible member having a front end and a rear end; a plurality of spaced annular flexible rings circumscribing the member and extending radially outward from the member for contacting the inside wall of the pipeline; and an elongated central aperture extending from the rear of the pig to a point beyond its midpoint and near the front end thereof for receiving fluid pressure within the pipeline to allow the fluid pressure within the pipeline to apply pressure to the nose of the pig in effect to pull the pig through the pipeline thereby facilitating movement of the pig through restricted areas or bends in a pipeline or through a pipeline having sections of different diameters. With this arrangement, a seal is maintained between the annular rings and the inside surface of the pipeline as the pig moves through different types of pipeline restrictions or configurations. In addition, the fluid pressure within the central aperture allows the pig to expand in the event the pig passes into a pipeline section having an increased diameter.

In a further aspect, the front end of the pig is defined by a forward projecting wall means extending from the member. The central aperture has a sidewall sealed to the exterior along its length from the rear end of the member to a point near the front end thereof.

In another aspect, the elongated member comprises a cylindrical member and the front end comprises a rounded or pointed member extending forward of the forwardmost annular ring.

In one embodiment, the annular rings comprise spaced groups of rings, while in another embodiment, the annular rings are formed of a foam type material.

In a further embodiment, there is provided a plurality of spaced passages extending from the central aperture through the front end for directing streams of fluid from the central aperture outward against the wall of the pipeline at positions forward of the pipeline pig to facilitate cleaning operations.

DETAILED DESCRIPTION OF THE DRAWINGS

Figure 1:
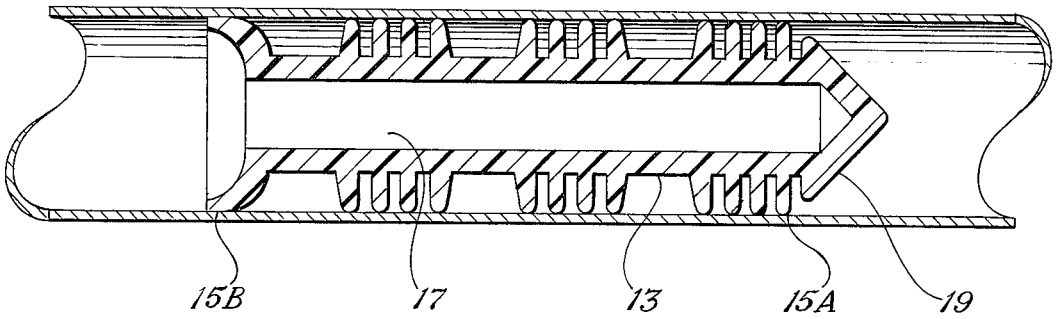
FIG. 1 is a cross section of one embodiment of the pipeline pig shown located in a pipeline.
Figure 2:
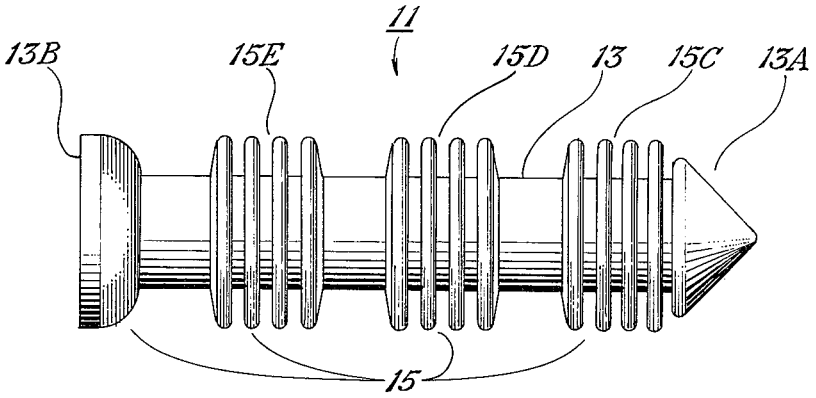
FIG. 2 is a side view of the pig of FIG. 1.

Referring now to FIGS. 1 and 2, the pipeline pig illustrated therein is identified at 11 and comprises an elongated flexible cylindrical member 13 having a front end or nose 13A and a rear end 13B. A plurality of spaced annular flexible rings 15 circumscribe the cylindrical member and extend radially outward from the member for contacting the inside wall of a pipeline. Formed in the member is an elongated central aperture 17 extending from the rear end to a point beyond its midpoint and near the front end thereof for receiving fluid injected into the pipeline. The front end is defined by a forward projecting wall 19 extending from the member 13 and in the embodiment of FIG. 1 is a pointed or cone shaped nose whose walls flare backward at an angle of 45° with respect to the axis of the cylindrical member 13. As illustrated, the front end 13A extends forward of the forwardmost annular ring 15A. The rearmost annular ring 15B extends outward from the rear end of the member 13 and defines the entrance to the aperture 17. In the embodiment of FIGS. 1 and 2, the pipeline pig is molded from a flexible material known as polyurethane of the ester material. It is a durable pig since its walls are relatively thick and moreover, it has a relatively large number of annular rings. This pig is used primarily for batching and separation of different types of petroleum liquids pumped down a pipeline. It is also used for cleaning and scraping the walls of the pipeline.

Since the aperture 17 extends to a point near the nose of the pipeline pig, fluid injected into the pipeline behind the pig will enter the aperture 17 and apply pressure to the nose of the pig in effect to pull the pig through the pipeline. With this arrangement, movement of the pig through restricted areas in the pipeline or through bends is facilitated since there is minimized any pushing action of the pig. In this respect, upon passage into a restricted area, for example, the fluid will apply fluid pressure to the nose of the pig to cause the pig to be pulled through the restricted area. Since the material is relatively flexible, the pig will be elongated as the fluid pressure in the nose pulls the pig through the restricted area thereby facilitating movement of the pig through restricted areas or through bends. Moreover, since the nose 13A is pointed, movement of the pig through restricted areas, such as a partially open valve, also is facilitated. In this case, the pointed nose of the pig will squeeze through the partially open valve and as the nose passes through the opening of the valve, the fluid pressure in the nose will pull the pig through the opening resulting in the pig being elongated, thereby facilitating movement of the pig through the valve opening. Since the annular rings 15 are flexible and are spaced apart, a sealing action is maintained between the pig and the inside wall of the pipeline as the pig is pulled or squeezed through the valve opening or through other restricted areas or bends in the pipeline.

In the embodiments of FIGS. 1 and 2, the rings are grouped in three spaced groups 15C, 15D, and 15E in order to allow the pig to elongate and bend more effectively in passing through pipeline bends and yet to provide an effective seal as it passes through a bend. In this respect, greater bending flexibility will occur in the cylindrical wall portions between adjacent groups of rings. As the pig passes through an elbow in a pipeline, the first group 15C will turn the corner, while 15D and 15E maintain a seal. As the pig continues to turn the corner, the first group 15C then will resume its sealing action whereby a complete seal is maintained as the pig passes through the elbow.

Figure 3:
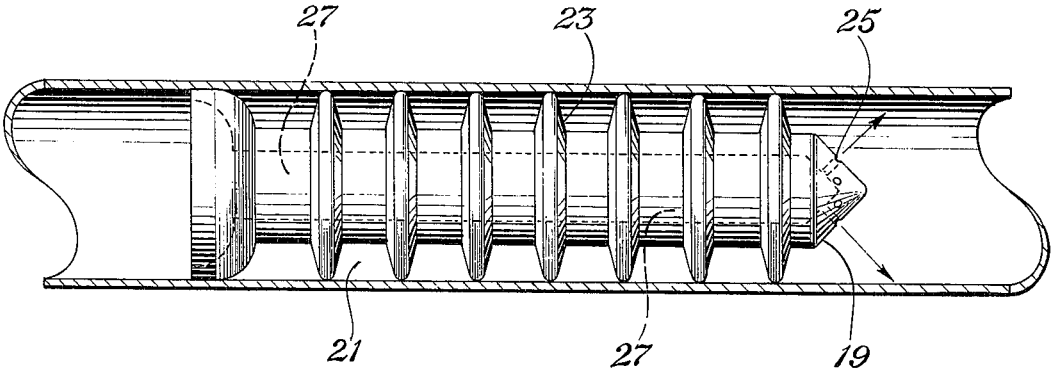
FIG. 3 is a pipeline pig similar to that of FIGS. 1 and 2 but having passages located in its nose for directing streams of fluid onto the pipeline wall ahead of the pig.

Referring to FIG. 3, there is disclosed a pipeline pig 21 which is used primarily for cleaning and scraping purposes. It is modified from the pig of FIGS. 1 and 2 in that the annular rings 23 are not grouped but have a thicker cross section and also are spaced further apart than those of FIGS. 1 and 2. The rings 23 are relatively thick to provide a better scraping action and are spaced relatively far apart to increase the flexibility of the pig. Also formed through the forward wall 19 are a plurality of spaced apertures 25 which form passages from the central aperture 27 to the exterior of the pig and which direct streams of fluid from the central passage 27 outward against the inside surface of the pipeline forward of the pipeline pig. These passages in effect provide jets of fluid which facilitate cleaning action ahead of the pig as it is propelled down the pipeline. This is important for example, in cleaning a pipeline of paraffin since otherwise the paraffin would tend to pile up ahead of the pig and cause it to become stuck.

The pig of FIG. 3 is especially useful in cleaning and maintaining older pipelines which have not been properly maintained. It may be used by itself or with another pig, for example, of the type illustrated in FIGS. 1 and 2 in the event that the pipeline is extremely corroded and deteriorated. In either case, the fluid injected behind the pig will enter the aperture 27 and pull the pig through the pipeline and yet allow fluid to be ejected in jet streams through apertures 25 ahead of the pig. In using the pig 21 by itself, it will be inserted in a pipeline and propelled forward by oil or other type of liquid by which the pipeline is being used to transport. In using the pig of FIG. 3 with another pig, the pig 21 will be inserted in the pipeline and then a given quantity of liquid solvent injected into the pipeline behind this pig. A second pig, for example, of the type illustrated in FIGS. 1 and 2 then may be inserted behind the solvent and fluid pressure such as gas or air injected behind the second pig to move the two pigs with the solvent down the pipeline. The solvent within the aperture 27 of the pig 21 then will be ejected forward through the apertures 25 to apply a jet action cleaning effect ahead of the first pig to facilitate removal of the paraffin.

In one embodiment, the apertures 25 are formed such that they allow the fluid streams to be injected at an angle of 45° outward from the axis of the pipeline. Four equally spaced apertures 25 are employed. The diameter of the apertures 25 may be of the order of one-fourth of an inch for a pig having a size sufficient for use in a pipeline having an inside diameter of about 8 or 10 inches.

Figure 4:
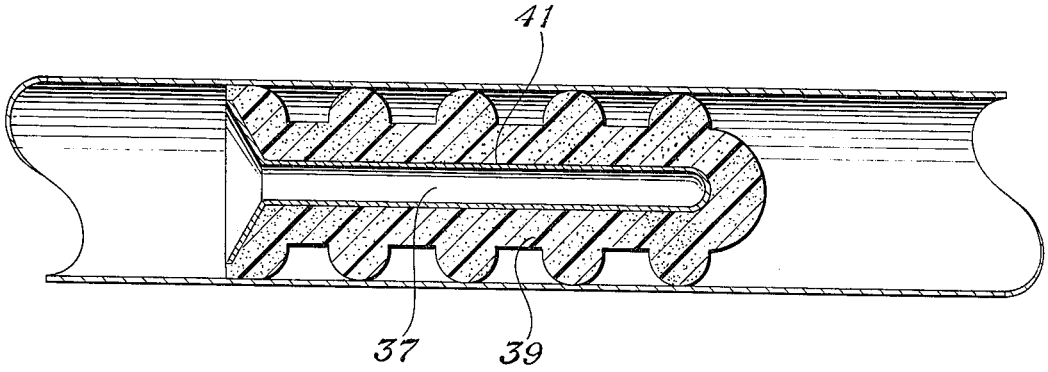
FIG. 4 is a cross section of another embodiment of the pipeline pig.
Figure 5:
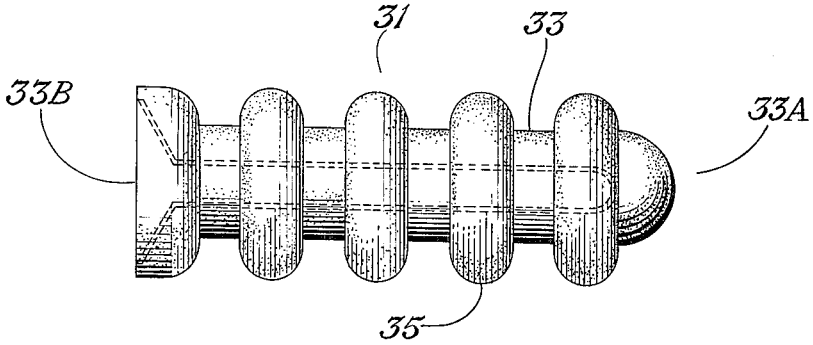
FIG. 5 is a side view of the pipeline pig of FIG. 4.

Referring now to FIGS. 4 and 5, the pipeline pig disclosed therein is identified by reference character 31 and comprises an elongated and flexible cylindrical member 33 having a plurality of spaced annular rings 35 circumscribing the cylindrical member and extending radially outward for contacting the inside wall of a pipeline. The pig also has a rounded front end 33A and a rear end 33B and in addition an elongated aperture 37 extending from the rear end to a point beyond its midpoint and near the front end thereof. The purpose of the aperture 37 also is to allow the fluid in the pipeline to enter into the aperture and to apply fluid pressure to the nose of the pig to allow the pig to be pulled through the pipeline to facilitate movement of the pig through restricted areas, bends, etc. This pig however, has its outer wall portion 39 including its annular rings 35 formed of a flexible, polyurethane foam of the ester material and bonded to a cylindrical inner wall 41 defining the central aperture 37. The wall 41 also is formed of polyurethane material of the ester type. The pipeline pig of FIGS. 4 and 5 is used primarily in a new pipeline for de-watering purposes. Since its outer rings are formed of foam material, they are very flexible and hence the operator has assurance that the pig will go all the way through the pipeline.

Figure 6:
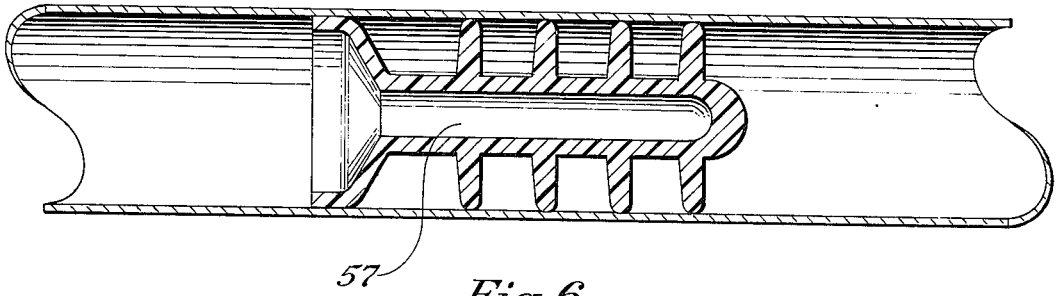
FIG. 6 is a cross sectional view of still another embodiment of the pipeline pig.
Figure 7:
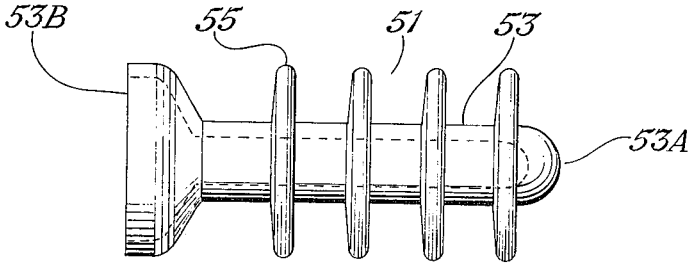
FIG. 7 is a side view of the pipeline pig of FIG. 6.

Referring now to the embodiment of FIGS. 6 and 7, the pipeline pig is identified by reference numeral 51 and also comprises a cylindrical member 53 having a plurality of annular rings 55 circumscribing the member. The forward end 53A is rounded and a central aperture 57 extends from the rear end 53B to a point near the nose thereof to allow fluid in the pipeline to apply pressure to pull the pig through a pipeline to allow it to be moved more readily through restrictions, bends, etc. The pig of FIGS. 6 and 7 is used primarily for de-watering purposes in pipelines formed of pipe sections of different diameters. For example, in the past, in constructing a pipeline, the construction company may have run out of pipe of a given diameter and rather than delay construction, started using pipe of a different diameter which may have been available at the time. The pig 51 is particularly useful in such pipelines since its walls are very flexible in that they are thin and in addition, the pig has less annular rings than the pigs of FIGS. 1–6, thereby allowing the fluid pressure to more readily expand the cylindrical walls to maintain a seal in the event that the pig passes from a pipeline section of one diameter to a section of a larger diameter.

In one embodiment, the pig of FIGS. 1–2 has a length of 30 inches and a maximum diameter of about 12 inches. The outside diameter of cylinder 13 is 8.5 inches. The aperture 17 from the rear end 13B to the forward end is about 27.37 inches. Its diameter is 6.5 inches. The groups of annular rings 15 are spaced four inches apart and the distance between the center points of the annular rings of each group is one inch. The rear annular ring 15B flares backward whereby its axial length is about 3.115 inches. The pig of FIG. 3 is formed of polyurethane of the ester material.

In the embodiment of FIGS. 4 and 5, the pipeline pig has a length of 23 inches and a maximum diameter of 10.25 inches. The aperture 37 has a diameter of 2.625 inches while the length of the aperture from rear end 33B is 17 inches. The space between the annular rings is one inch while the axial width of each annular ring is three inches. The rearmost annular ring had an axial length of four inches.

In the embodiment of FIGS. 6 and 7, the pipeline pig had a total length of 23 inches and a maximum diameter of 10.625 inches. The aperture 57 has a diameter of 4.750 inches while the outside diameter of the cylinder 53 is six inches. The aperture 57 has a length from the rear end 53B to the nose of about 22 inches. The distance between the midpoints of the annular rings are about 4.125 inches while the rearmost annular ring has an axial length of about 3.5 inches.

The pigs of FIGS. 1–6 are capable of withstanding fluid pressures of up to 1000 psi.

I claim:

1. A pipeline pig adapted to be propelled through an oil and gas pipeline by fluid pressure injected into the pipeline comprising:

an elongated flexible member having a front end and a rear end, a plurality of spaced annular flexible rings circumscribing said member at positions spaced inward from said front and rear ends and extending radially outward from said member for contacting the inside wall of a pipeline, all of said plurality of annular rings have substantially the same diameter, said pig, including said elongated member and said annular rings, being formed of non-metallic flexible material capable of bending or flexing and resuming its original shape, said elongated member having an elongated central aperture open at its rear end and extending from its rear end forward to a point beyond its midpoint and near the front end thereof for receiving fluid pressure to facilitate movement of the pig through a pipeline, said front end being defined by a forward projecting wall means which extends forward of the forwardmost annular ring and is smaller in cross section than the cross section of said forwardmost annular ring, said central aperture having its sidewall closed to the passage of fluid therethrough along its length from the rear end of said member to a point near the front end thereof, said annular rings being formed of polyurethane foam, said central aperture being formed by a non-porous liner around which the foam material is bonded.

2. A pipeline pig adapted to be propelled through an oil and gas pipeline by fluid pressure injected into the pipeline comprising:

an elongated flexible member having a front end and a rear end, a plurality of spaced annular flexible rings circumscribing said member at positions spaced inward from said front and rear ends and extending radially outward from said member for contracting the inside wall of a pipeline, all of said plurality of annular rings have substantially the same diameter, said pig, including said elongated member and said annular rings, being formed of non-metallic flexible material capable of bending or flexing and resuming its original shape, said elongated member having an elongated central aperture open at its rear end and extending from its rear end forward to a point beyond its midpoint and near the front end thereof for receiving fluid pressure to facilitate movement of the pig through a pipeline, said front end being defined by a forward projecting wall means which extends forward of the forwardmost annular ring and is smaller in cross section than the cross section of said forwardmost annular ring, said central aperture having its sidewall closed to the passage of fluid therethrough along its length from the rear end of said member to a point near the front end thereof, a rear annular ring which extends outward from said rear end and which defines the entrance to said central aperture, said rear annular ring having substantially the same diameter as the diameter of said plurality of annular rings, said rear annular ring being formed of non-metallic flexible material capable of bending or flexing and resuming its original shape, said annular rings and the outer wall structure of said elongated member being formed of foam-like material, said central aperture being formed by a non-porous liner around which the foam-like material is bonded.

3. The pipeline pig of claim 2 wherein said plurality of annular rings comprise more than two annular rings.

4. The pipeline pig of claim 2 wherein:

the angle formed between the front wall of each of said annular rings and the portion of the axis of said elongated member ahead of each of said front walls being not less than about 90°, the angle formed between the rear wall of each of said annular rings ahead of said rear annular ring and the portion of said axis behind each of said rear walls being not less than 90°.

5. The pipeline pig of claim 4 wherein each of said annular rings ahead of said rear annular ring has a curved outer surface between its front and rear walls.

6. A pipeline pig adapted to be propelled through an oil and gas pipeline by fluid pressure injected into the pipeline comprising:

an elongated flexible member having a front end and a rear end, a plurality of spaced annular flexible rings circumscribing said member at positions spaced inward from said front and rear ends and extending radially outward from said member for contacting the inside wall of a pipeline, said front end of said pig being defined by a forward projecting wall means which extends forward of the forwardmost annular ring and is smaller in cross section than the cross section of said forwardmost annular ring, said member having an elongated central aperture open at its rear end and extending from its rear end forward to a point beyond its midpoint and near the front end thereof for receiving fluid pressure to facilitate movement of the pig through a pipeline, a rear annular ring extending outward and rearward from said rear end and which defines the entrance to said aperture, all of said annular rings having substantially the same diameter, the angle formed between the front wall of each of said annular rings and the portion of the axis of said elongated member ahead of each of said front walls being not less than about 90°, the angle formed between the rear wall of each of said annular rings ahead of said rear annular ring and the portion of said axis behind each of said rear walls being not less than 90°, each of said annular rings ahead of said rear annular ring having a curved outer surface between its front and rear walls, said annular rings and the outer wall structure of said elongated member being formed of foam-like material, said aperture being formed by a non-porous liner having closed sidewalls and a closed front end around which said foam-like material is bonded, said foam-like material and non-porous liner being capable of bending or flexing and resuming their original shape.

7. The pipeline pig of claim 6 wherein:

said central aperture has the same cross sectional size over a major portion of its length, said forward projecting wall means decreases in size toward its front end, and said pig, including said elongated member and said annular rings, being formed of non-metallic material.

8. The pipeline pig of claim 7 wherein said forward projecting wall means is rounded and extends forward of the forwardmost annular ring.

9. The pipeline pig of claim 7 wherein said liner and foam-like material are formed of polyurethane.

* * * * *